United States Patent [19]

McWatters

[11] 3,959,898

[45] *June 1, 1976

[54] DREDGE LADDER SHOCK MOUNTING ARRANGEMENT

[76] Inventor: William Andrew McWatters, c/o P. E. Terry, Charlton Road, East Brookfield, Mass. 01506

[ * ] Notice: The term of this patent subsequent to July 2, 1991 has been disclaimed.

[22] Filed: May 21, 1974

[21] Appl. No.: 471,897

Related U.S. Application Data

[62] Division of Ser. No. 195,674, Nov. 4, 1971, Pat. No. 3,821,859.

[52] U.S. Cl. ..... 37/72; 37/73; 188/268; 308/26; 403/151

[51] Int. Cl.[2] ..... F02F 3/90; F16F 9/00

[58] Field of Search ..... 212/3, 8 R, 8 A, 8 B, 212/9, 35 R, 35 HC, 52, 53, 54, 58 R, 58 A, 59 R, 59 A, 70, 144; 308/26, 184 R, 184 A; 403/14, 225, 13, 229, 24, 167, 263, 287, 383, 151; 37/73, 58, 64–67, 72; 248/15, 8, 204, 291, 358; 188/268

[56] References Cited

UNITED STATES PATENTS

| | | | |
|---|---|---|---|
| 110,259 | 12/1870 | Martinson | 308/26 UX |
| 656,369 | 8/1900 | Osgood | 37/73 |
| 1,189,606 | 7/1916 | Miller | 403/383 X |
| 1,272,110 | 7/1918 | Robinson | 37/73 |
| 1,768,290 | 6/1930 | Newkirk | 308/26 X |
| 2,093,062 | 9/1937 | Watson | 74/18.2 X |
| 2,096,392 | 10/1937 | English | 254/190 R |
| 2,559,933 | 7/1951 | Briney | 403/229 X |
| 2,852,223 | 9/1958 | Roberts | 248/358 AA |
| 3,050,880 | 8/1962 | Cushing, Sr. | 37/73 |
| 3,494,678 | 2/1970 | Reznick et al. | 308/184 X |
| 3,684,245 | 8/1972 | Marichev et al. | 254/190 |
| 3,821,859 | 7/1974 | McWatters | 37/73 X |

*Primary Examiner*—Clifford D. Crowder
*Attorney, Agent, or Firm*—Craig & Antonelli

[57] ABSTRACT

Shock mounting arrangements for mounting one end of a rigid dredge ladder and for mounting the holding spud on a dredging barge or dredging platform. In the ladder mounting, pivot pins are connected to one end of the ladder for permitting pivotal movement of the ladder thereabout. The pivot pins are supported in rigid housing structures attached to the barge structure. These housing structures include a plurality of coil springs operatively engaging the pins and the rigid housing structure such that the pins are normally held in a fixed position but are permitted limited radial movement in response to dredging operation shock forces transmitted by way of the ladder to the pin means. Guide means can also be provided to limit the motion of the pin means along a single plane extending perpendicularly to the pivot axis of the ladder. Other shock absorbing means, such as hydraulic means or rubber means can be substituted for the spring means. One arrangement of the invention provides for mounting the dredge ladder for pivoting movement about an axis at the rear of the barge, while another embodiment provides for pivotally mounting the ladder forwardly of the rear of the barge. In the holding spud mounting, a vertically extending housing is provided with radially extending springs for supporting the holding spud in vertical position with respect to the barge. These springs permit limited radial movement to attenuate shifting shock forces caused by winds and water swells.

15 Claims, 16 Drawing Figures

1
2
3
4
5
6
6'
7
7'
p
p'

22,22'

20,20'

14,14'

7
9
16
16'
29
35
36

FIG. 10
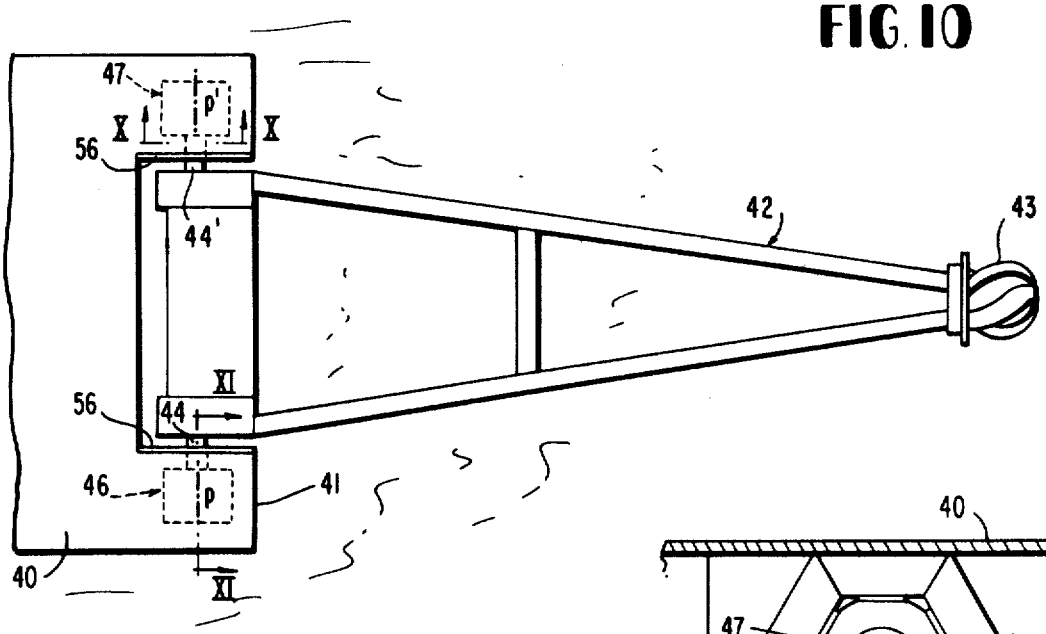
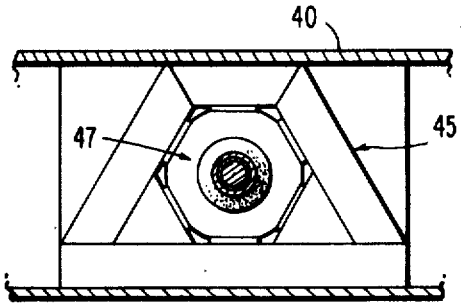
FIG. 10A
FIG. 13
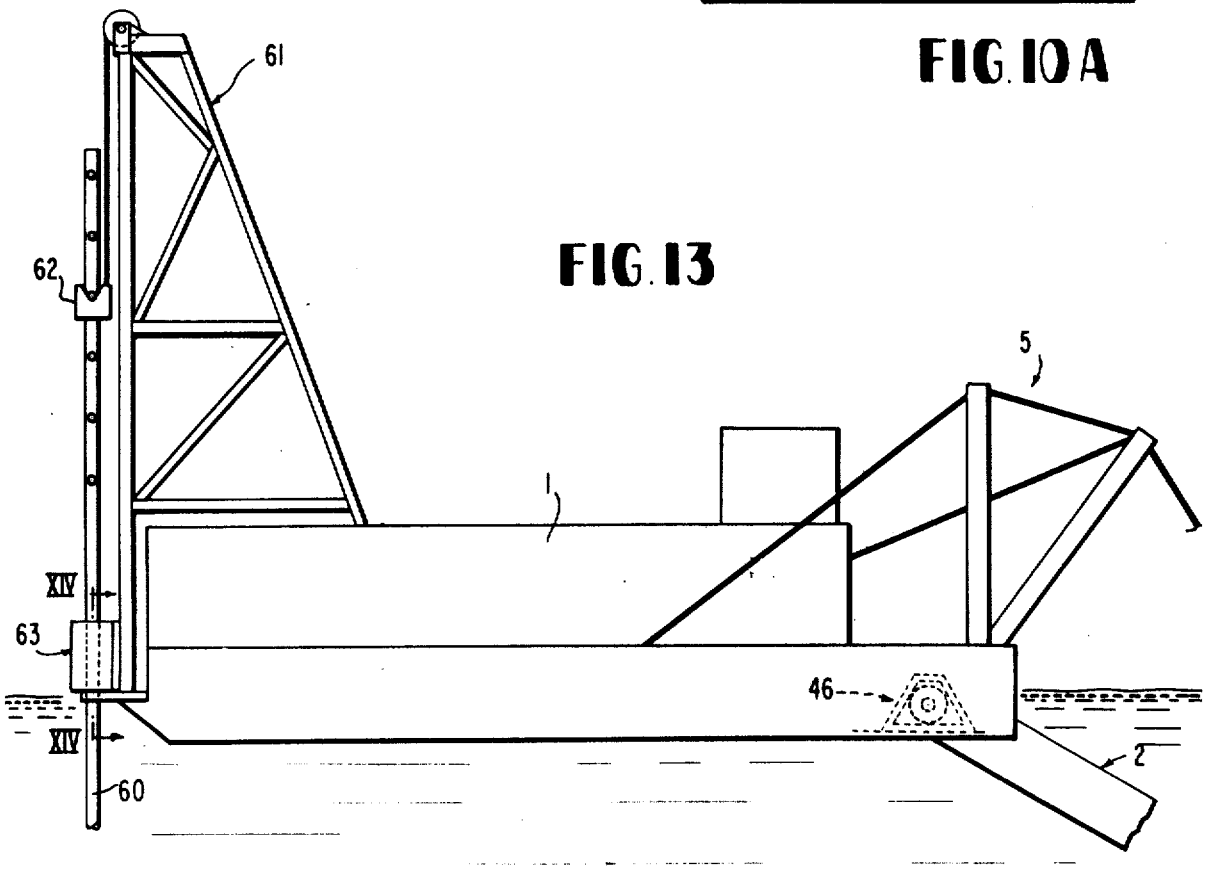

DREDGE LADDER SHOCK MOUNTING ARRANGEMENT

This is a division of application Ser. No. 195,674 filed Nov. 4, 1971 now U.S. Pat. No. 3,821,859.

BACKGROUND OF THE INVENTION

The present invention is related to the mounting of a rigid dredge ladder and to the mounting of a holding spud on a dredging barge or dredging platform. It is particularly related to a shock mounting arrangement for a pivotal connection between the barge structure and the ladder structer. It is also particularly directed to a shock mounting arrangement for a holding spud on a barge structure.

Prior dredging apparatus have included pivotally mounted rigid dredge ladders attached to the barge on platform structure. At the end of the rigid dredge ladder opposite the pivotal connection with the barge, a drilling or dredging head was securely attached. The ladder and attached dredging head could be lowered into engagement with the material to be dredged by pivoting about the pivot connection with the barge. With these prior arrangements, the pivotal connection between the dredge ladder and the barge structure provided a rigid continuous structure for holding the drilling or dredging head against the surface to be dredged.

A major disadvantage of this known dredging apparatus arises from the fact that there were no effective means for cushioning shock forces experienced by the drilling or dredging head, such as when it came into contact with rock or other hard surfaces. Consequently, these shock forces were transmitted directly through the rigid ladder to the mounting attachement at the barge or platform. These forces were, in many cases, sufficient to cause extensive damage to the mounting connection between the rigid ladder and the barge structure. Also, the drilling or dredging head and the barge structure itself could be damaged by these relatively unattenuated shock forces.

Since these dredging machines are, of necessity, of such heavy and expensive construction, the repairs likewise are exceedingly expensive. In addition, the money lost due to shut-downs for any repairs are also exceedingly great. For example, dredging machines of the type discussed may have initial cost running in excess of approximately ten million dollars. Therefore, the reduction of repair or dry-dock downtime by even a few days a year would constitute considerable savings.

Another disadvantage of the known dredging apparatus was that the mounting connection between the rigid dredge ladder and the barge or platform was difficult to disassemble and repair. This fact further increased the potential downtime caused by the drilling or dredging shock forces transmitted through the ladder to the barge. In some cases, the failure of a relatively small structural element of the connection between the ladder and the barge would require a complete shut-down of the dredging operation for repair.

Another disadvantage of the known dredging apparatus was that the holding spud for holding the barge or platform in position during a dredging operation was also subjected to shock forces. These shock forces would be transmitted from the holding spud to the barge structure or the spud gate and spud frame holding the spud in position with respect to the barge. These shock forces would be caused basically by high winds and/or swells or waves in the water. The present invention is particularly directed to an improved shock lining or mounting arrangement between the spud and the barge structure such that shock forces are attenuated by allowing a limited radial movement of the spud with respect to the barge structure during extreme swell conditions.

SUMMARY OF THE INVENTION

The present invention is directed to overcoming the afore-mentioned disadvantages of the prior art.

The present invention provides a mounting between the rigid ladder and the dredge or barge platform structure which effectively absorbs the shock forces experienced by the drilling or dredging head by permitting a slight radial movement of the dredge ladder with respect to the ladder pivot axis. The present mounting is also operative to maintain the ladder in a fixed relatively rigid position for normal dredging operations, since significant movements of the dredge ladder are permitted only in the event of large predetermined shock forces of the magnitude that could cause structural damage to the dredge ladder, drilling head, or barge structure.

In the present invention, the rigid dredge ladder is pivotally mounted by way of bearings to pivot pins extending perpendicular to the longitudinal extent of the dredge ladder. These pivot pins are supported, at least at their outer ends, within rigid housing means fixedly attached to the barge structure. These housing means include shock absorbing structure for permitting a slight movement of the pivot pins with respect to the rigid barge and housing structure.

In a preferred embodiment of the present invention for use on barges of the type having a ladder mounted at the rear end face of the barge, two separate pivot pins are provided. Each of these pivot pins extend through bearing means provided in respective arms on the ladder. Each pin is supported at its respective ends by housing structures fixed to the rear edge of the barge. Each of the housing structures includes sliding block means having an opening for the acceptance of the respective ends of the pin. These sliding block means are mounted for movement within the housing fixtures by means of a plurality of springs engaging the sliding block means at least at two opposite sides thereof. In this manner, the block means are suspended between the respective springs, thereby holding the pins resiliently suspended with respect to the barge structure. The spring means are maintained in a position so as to exert only forces in the radial direction with respect to the axis of the pin, or the ladder pivot axis, by means of cylindrical spring guide chambers provided in the houing. Spring abutment guides are also provided on the sliding block means for holding the ends of the springs in engagement therewith. The springs are pretensioned against the sliding block by means of removable and adjustable spring back-up plugs threaded into the outer end of the cylindrical guide chambers. These adjustable back-up means can be locked into position by means of a lock nut having a thread of opposite hand with respect to the back-up means.

In one of the preferred embodiments, each of the pins is constructed with one end portion of rectangular cross-section and the other end portion of cylindrical cross-section. Each set of housing support structures for a particular pin includes one housing having a sliding block with a cylindrical opening for acceptance of the cylindrical end portion of the pin and another housing structure with a sliding block having a rectangular cross-section opening for accepting the rectangular cross-section end portion of the pin. Both housing structures include parallel guide walls for guiding the respective sliding blocks in a linear radial direction with respect to the pivot axis of the ladder. The ladder leg is attached to the cylindrical portion of the pin by way of bearing means between the two respective housing structures. With this arrangement, the pins are nonrotatably held with respect to the barge and housing structure, while permitted to move linearly such that the pivot axis of the ladder can be moved within a plane perpendicular to the said pivot axis. The housing structures may also include end plate means for abutting against the respective ends of the pin to hold it in place. At least the end plate associated with the housing means having the rectangular cross-section apertured sliding block is readily removable such that the pin can be inserted or removed from the mounting arrangement. Since the rectangular cross-section opening in the sliding block is larger than the cylindrical section of the pin, the pin can be inserted through this sliding block, then through the bearing means in the ladder leg, and finally into the sliding block of the other housing support.

Lubricating means are provided within the housing structures for lubricating the relatively sliding surfaces and the spring means. In addition, a flexible seal is provided between the respective housing structures and the pin so as to preclude the loss of the lubricating means and to preclude the entry of water and other foreign substances into the housing structures. This sealing means is arranged as a flexible sheet which permits the radial movement of the pin means with respect to the housing structure while still maintaining an adequate seal.

Another preferred embodiment of the present invention for use on barges of the type having the ladder pivotally mounted inwardly of the rear edge of the barge or platform includes two housing structures mounted within the framework of the barge for accepting opposite ends of pivot pin means extending from respective sides of the ladder. This arrangement can utilize either a single pin extending entirely through the ladder or can use separate pins fixed to respective arms of the ladder. Each of the housing structures include, like the arrangement of the first embodiment, spring means for resiliently suspending the ends of the pivot pin. The barge includes a central opening extending from the rear of the barge forwardly beyond the position where the ladder pivot axis is for permitting the pivotal downward movement of the dredge ladder during use.

Each of the housing structures is fixed to the barge framework at a position beneath the deck of the barge and above the lower bulkhead or bottom surface of the barge. This attachment to the basic barge structure, beneath the deck surface, provides for an optimum utilization of the barge deck and for an optimum utilization of the basic barge structural units. In this embodiment, a plurality of circumferentially spaced, radially extending, springs are provided for suspending a movable support block through which the pin extends. This arrangement differs from the other embodiment in that the pivot pin can move in any radial direction. A particularly advantageous arrangement utilizes sic equally circumferentially spaced coil springs engaging with abutment means on a removable block directly supporting the pivot pin. In order to assure that sufficient spring forces are present for supporting the very large loads on the pivot pin, any number of sets of springs can be arranged longitudinally of the pivot pin within the housing structure. In this embodiment, cylindrical guide chambers in the housing can also be used for holding the springs in position. In addition, removable back-up means and locking plug means of the type described for the embodiment mounted at the rear of the barge could also be utilized, however a preferred arrangement utilizes a plurality of back-up heads, each covering three springs. This arrangement provides for the easy removal and repair or replacement of individual springs. Also, the block preferrably is in two sections to aid assembly.

Also, this embodiment utilizes removable outside end plates on the housing structures for permitting the simple insertion and removal of the pivot pin and movable support block structure. With this end plate removed, the pivot pin and support block structure can be inserted into the housing. Also, with this arrangement, the aperture in the movable support block can be cylindrical and include bearing means for permitting rotation of the pivot pin, or in addition, or alternatively, the pivot pin can pivot about bearings in the ladder structure.

This embodiment also utilizes seal means between the housing structure and the support block or pivot pin to hold lubricants inside of the housing structure and to prevent water and other foreign material from entering therein. In addition, seal means are provided between the pivot pin and/or the movable support block and the inside bulkhead to prevent water from reaching the pivot pin. Both of these sealing means can be resilient diaphragm-like sheets of material which will permit the slight radial movement of the pivot pin and support block with respect to the housing structure and the bulkhead structure.

Another embodiment of the invention is directed to a shock mounting arrangement for the holding spud between the spud and the barge structure. This embodiment utilizes a housing and spring arrangement substantially similar to the arrangement of the embodiment mounting the pivotal ladder inwardly from the rear of the barge. The major difference in this embodiment being that the longitudinal centerline of the housing chamber extends substantially vertical with respect to the barge structure, rather than horizontal, as do the dredge ladder pivot arrangements. This embodiment basically utilizes the plurality of radially extending springs to position a spud supporting movable block centrally within the housing. Upon heavy swells or heavy wind conditions, the barge structure is moved relative to the point of the spud driven into the underwater surface. This relative motion between the spud and the barge structure is attenuated by means of the spring allowing the limited radial movement of the spud supporting block. A collar is provided adjacent the bottom of the housing supporting the springs, to prevent the spud supporting block from falling to the bottom of the spud spring during assembly or use thereof. For example, this collar provides a bottom rest for the supporting block, in the event the radially extending springs become inoperative to hold it in the vertical position along the spud. Also in this embodiment, a split ring arrangement is utilized to hold the spud supporting block in position from the upper end thereof. This split ring is composed of two half rings, each bolted by a plurality of bolts to the basic housing structure holding the spring means.

All of the basic embodiments of the present invention exhibit the advantage that they are simple to construct and install on existing barges, in addition to being usable on brand new barge structures. Also, each of the embodiments are easily repairable because of the various features providing for the removal and replacement of many of the basic structural parts that would possibly fail in service, rather than requiring a complete dismantling of the assembly. For example, the removable heads and plugs for the springs, and the removal of the pivot pins or spud supporting holders can take place without removing the fixed housing structures from the barge. Further advantages of the present invention reside in the provision for lubrication of relatively moving parts and for sealing the relatively moving parts with respect to the surrounding water environment. Another particular advantage of the present invention is the utilization of the basic barge structure to hold the necessarily heavy spring mounting arrangements in place.

These and other objects, features, and advantages of the present invention will become more apparent from the following description thereof, when taken in connection with the accompanying drawing.

BRIEF DESCRIPTION OF THE DRAWINGS

FIG. 10 discloses, in schematic form, a second embodiment of the invention wherein the ladder pivot axis is positioned inwardly from the rear edge of the barge or platform.

FIG. 10A is a partial cross-sectional schematic view taken along the plane X—X of FIG. 10.

FIG. 13 is a schematic, partial cross-sectional view of a barge including both a ladder pivot arrangement corresponding to FIG. 10 and a mounting for a holding spud.

DESCRIPTION OF THE PREFERRED EMBODIMENTS

Figure 1:
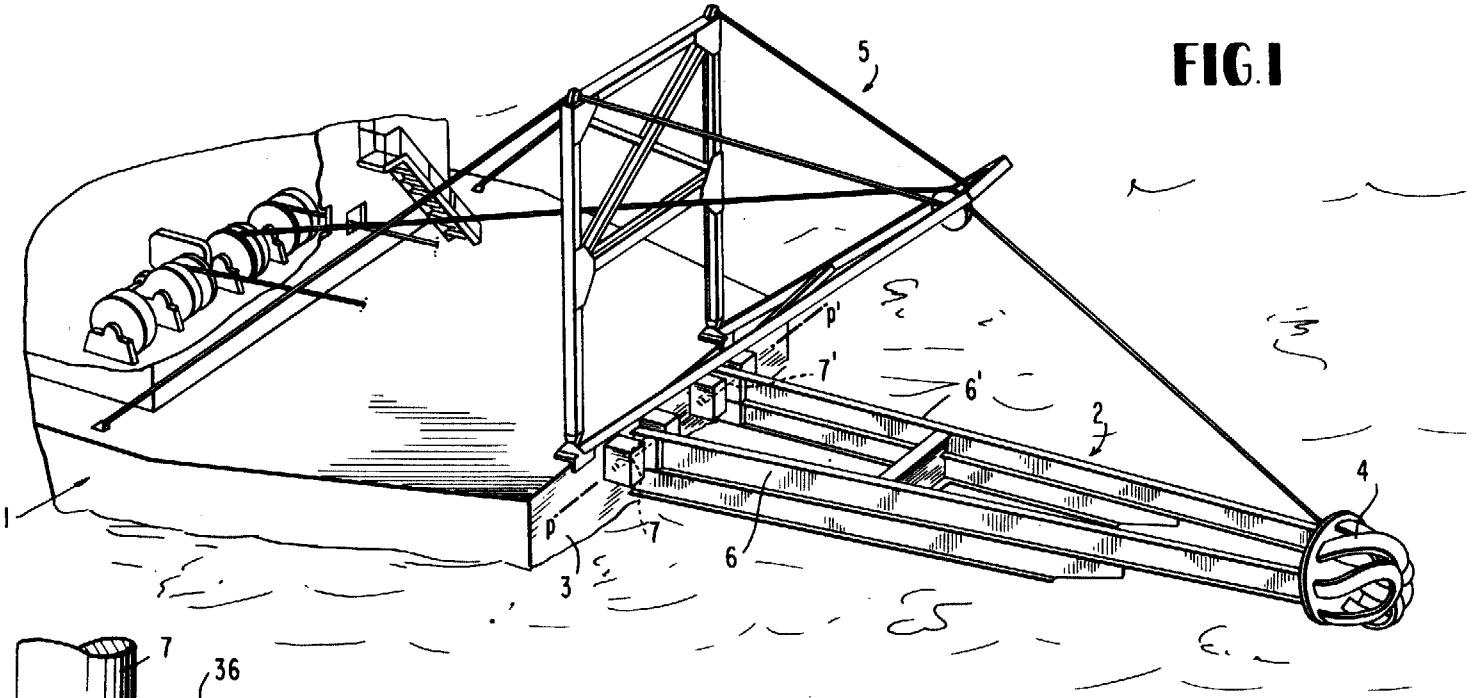
FIG. 1 shows a dredging apparatus with a schematic representation of a first embodiment of the ladder mounting arrangement of the present invention.

Referring now to the drawings, wherein like reference numerals are used throughout the Figures to designate like structure, and more particularly to FIG. 1, the dredge barge or platform 1 has a rigid dredge ladder 2 pivotally connected at the rear end face 3 of the barge. This dredge ladder 2 is constructed substantially rigid throughout its length by known means. A drilling or dredging head 4 is provided at the outermost end of this dredge ladder 2. Driving means (not shown) for the dredging head 4 are provided on the barge and extend along the dredge ladder 2. A winching arrangement 5 is provided for lowering the drilling head at the end of the dredge ladder 2 into engagement with the surface to be dredged.

The dredge ladder includes a lefthand leg 6 and a righthand leg 6'. Pivot pins 7 and 7' extend through bearing means, such as shown at 8 in FIG. 2, wherein the mounting arrangement for the left leg of the ladder is illustrated. Since the mounting arrangement for the pin 7' of the right leg 6' of the ladder 2 is the same as for the left pivot pin 7, a detailed illustration of this right pivot pin mounting is dispensed with.

Figure 2:
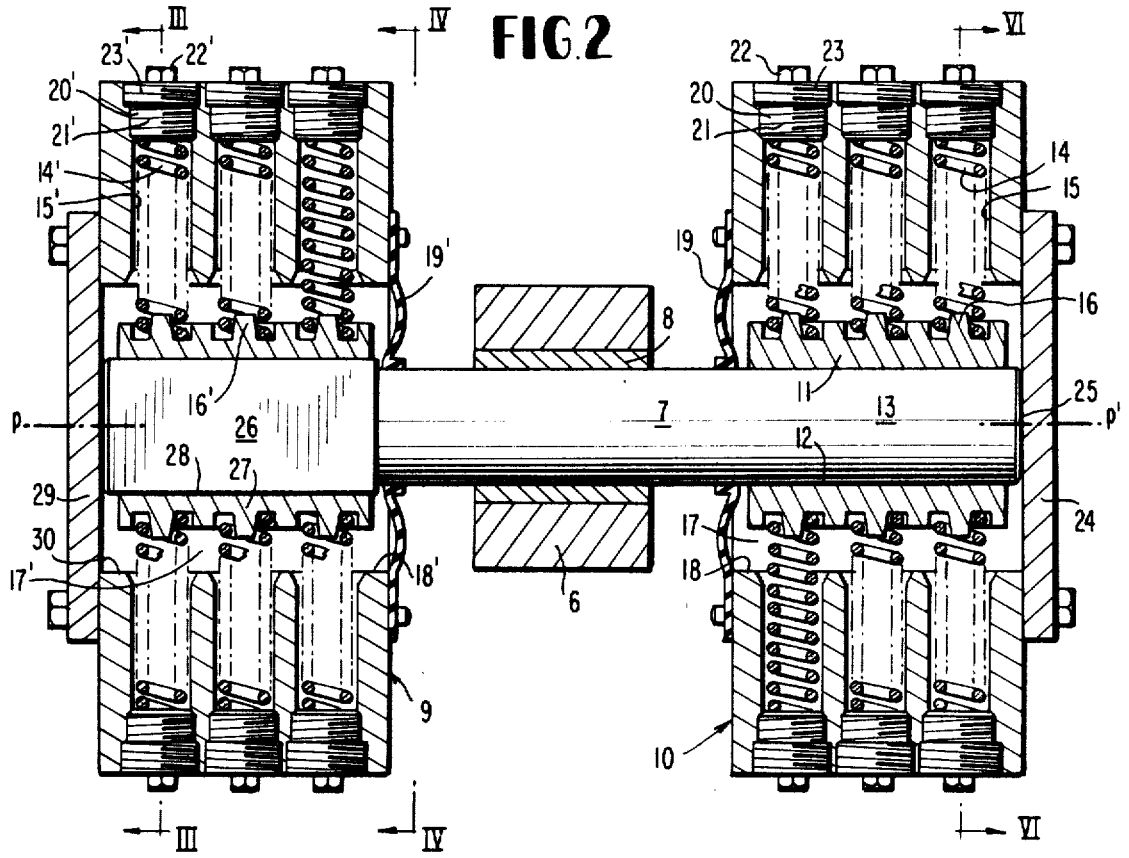
FIG. 2 is a partial cross-sectional showing of the mounting connection for one of the ladder legs.

As best seen in FIG. 2, the mounting for the pivot pin 7 includes two spaced rectangularly shaped housing structures 9 and 10 disposed at respective opposite ends of the pivot pin 7. The innermost housing structure 10 includes a sliding block 11 having a cylindrical opening 12 for slidably accepting an inner end portion 13 of the pivot pin 7. Coil springs 14 are arranged in cylindrical guide chambers 15 provided in the housing 10. These coil springs 14 operatively engage radially opposite abutment means or guides 16 provided on the sliding block 11. In this manner, the coil springs operatively hold the sliding block 11, and the associated end 13 of the pivot pin approximately midway between the top and bottom of the housing chamber 17.

The housing structure 10 has a first opening 18 which is substantially larger than the cylindrical inner end portion 13 of the pivot shaft, and which is large enough to accommodate the sliding block 11 therethrough. A first flat resilient seal means 19 is disposed between the surface of the pivot pin and the housing walls adjacent the first opening 18 to preclude entry of water and other foreign material into the housing chamber and to sealingly hold lubricating material within the housing chamber.

Each of the cylindrical guide chambers 15 is provided with a removable backing or back-up plug 20 at its outer end. This backing plug 20 is threadably engaged in righthand threads 21 provided in the upper portion of the guide chamber 15. This back-up plug 20 can be tightened a predetermined amount to pretension the springs to the desired value. Immediately outward of the back-up plug 20 is a locking plug 22 which is threadably engaged by way of lefthand threads 23 in the housing 10. A removable end plate 24 is provided for abuttingly engaging the end 25 of the pivot pin 7 to hold it in place within the housing 10.

Figure 3:
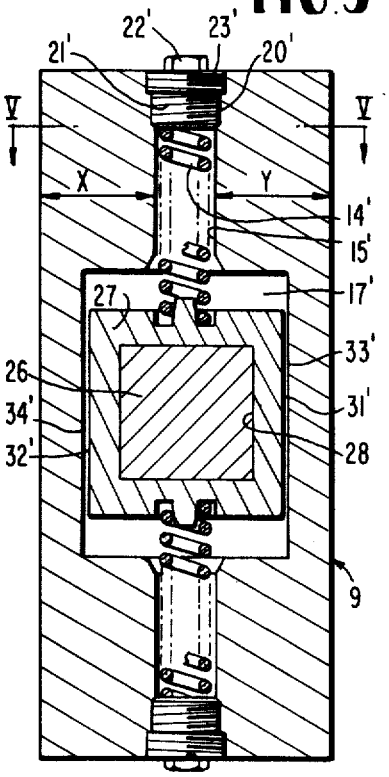
FIG. 3 is a partial cross-sectional view through plane III—III of FIG. 2.

The basic arrangement of the housing 9 is substantially similar to the housing 10. Therefore, structure of housing 9 which is substantially identical to the equivalent structure in housing 10 is designated by primed reference numerals similar to the reference numerals shown for the corresponding parts in housing 10. The outer end portion 26 of the pivot pin 7 is of a rectangular cross-section, as best shown in FIG. 3. Sliding block 27 has a rectangular cross-sectional opening 28 for accepting this outer end portion 26. This rectangular opening 28, and corresponding outer end portion 26 of pivot pin 7 is sufficiently larger than the cylindrical inner end portion 13 so that the pin 7 can be inserted, from the left, as indicated in FIG. 2, through the block 27. An outer end plate 29 is provided for closing the opening 30 at the left side of housing 9.

Figure 6:
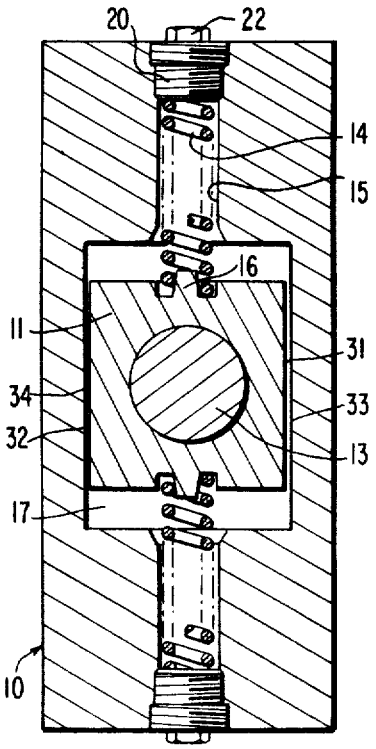
FIG. 6 is a partial cross-sectional view taken along plane VI—VI of FIG. 2.

Sliding block 11 is provided with two parallel side surfaces 31 and 32 for slidably engaging surfaces 33 and 34 of the housing chamber 10 such that the block 11 is constrained to linear movement within the housing chamber 17. (See FIG. 6). Sliding block 27 of housing 9 is also constrained by similar sliding wall surfaces as shown in FIG. 3, primed reference numerals indicating like parts from the housing of FIG. 6. Although the drawings show the distances X and Y in FIG. 3 to be approximately equal, the side of the housing X connected to the barge may advantageously be smaller than the other side Y.

Figure 9:
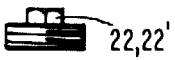
FIG. 9 discloses a lock nut for locking the spring back-up plug of FIG. 8 in position.
Figure 8:
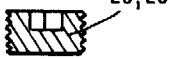
FIG. 8 discloses an adjustable spring back-up plug for use with the present invention.
Figure 7:
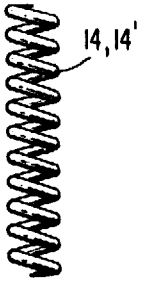
FIG. 7 shows a coil spring for use with the present invention.
Figure 5:
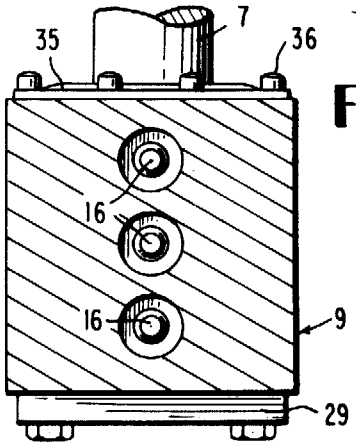
FIG. 5 is a partial cross-sectional view taken through plane V—V of FIG. 3.
Figure 4:
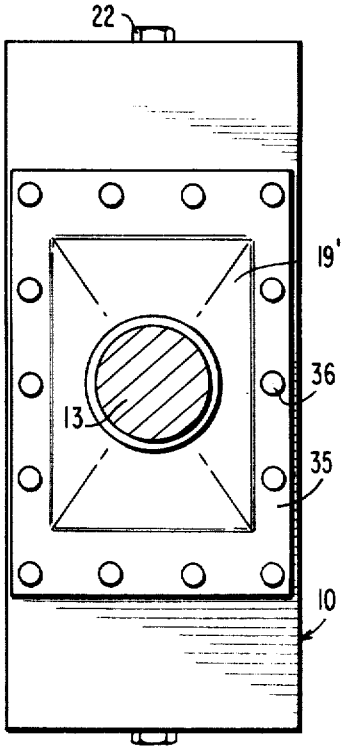
FIG. 4 is a cross-sectional view taken along plane IV—IV of FIG. 2.

FIG. 4 is a partial cross-sectional end view showing the attachment of the seal means 19' to the housing 9 by way of seal plate 35 and seal plate fasteners 36. FIG. 5 discloses a top cross-sectional view of the housing structure 9 with the back-up plugs 20 and locking plugs 22 removed. FIGS. 7, 8 and 9 are detailed showings of a spring 14, 14', a back-up plug 20, 20', and a locking plug 22, 22', respectively.

The assembly of the embodiment of FIGS. 1 to 9 will be described for the left leg 6 of the rigid ladder, it being understood that the assembly of the right leg 6' into the mounting arrangement will be similar thereto. The two housing 9 and 10 are fixed to the rear end face of the barge or platform 3 by, for example, welding. These housings 9 and 10 are spaced apart and aligned with one another such that the first opening 18 of housing structure 10 is essentially aligned with respect to a first opening 18' of the housing structure 9. The sliding blocks 11 and 27 can then be positioned in their respective housings and can be suspended centrally within the housings on the coil springs 14, 14'. The ladder leg 6 is then held such that its bearing means 8 is aligned with the openings 18 and 18' of the housing structures, while the pivot pin is slidably inserted first through opening 30 of housing structure 9, then through sliding block 27, then through the bearing 8 on the ladder leg 6 and then into the sliding block 11. Then the end plates 24 and 29 can be fixedly secured to the outer ends of the housings to hold the pivot pin in axial position. The springs 14, 14' may then be pretensioned the desired amount by means of the back-up plugs 20. The springs 14 and 14' can be inserted into the housing and removed from the housing for repair by way of the opening provided upon removal of the back-up plugs 20, 20' and lock plugs 22 and 22'. The seals 19 and 19' can be arranged on the respective housings prior to the installation of the pivot pin.

During normal operation of the dredging apparatus shown in FIG. 1, the pivot pins, and consequent pivot axis *p—p* of the rigid dredge ladder 2 will be held in a relatively fixed position. This arrangement thereby enabling normal dredging operation to take place by providing a rigid effective unitary platform from the drilling or dredging head 4 to the barge structure 1. When the drilling or dredging head runs into hard rocks or other hard material, or possibly uneven terrain features, shock forces will be sent to the pivot pins 7 and 7' by way of the dredge ladder 2 and the bearings 8, 8'. Since the pivot pins are supported in the spring mounted sliding blocks 11 and 27, these shock forces will cause a movement of the pivot pins upward or downward against the springs. Consequently, the shock forces will be attenuated and absorbed by the springs and by the movement of the pivot pins and ladder structure. Due to this shock attenuation, the potential damages to the drilling or dredging head will be significantly reduced. Further, this shock attenuation also protects the pivotal connection between the dredge ladder and the barge, and the dredge ladder and barge structure itself. In the FIG. 1 embodiment, the pivot pin is constrained to move up and down in a vertical direction in a plane parallel to the rear end face 3 of the barge. This is a preferred arrangement, however the movement of the pivot pin could be along planes other than planes parallel to the rear end face 3 of the barge. For a given dredging machine, with a given pivotal position of a dredge ladder, other angles of inclination of the movement of the pivot axis may be desired.

The particular size of springs and other structure to be used will, of course depend upon the particular size of the dredge ladder, barge, and associated structure. For purposes of example, springs having a spring constant corresponding to, on the order of, 20 tons/inch could be used. In the just described embodiment, each of these springs could be put under a pretension of approximately 5 inches, leaving an additional 5 inches total possible deflection during usage thereof. Correspondingly rigid housing structure, sliding block structure, and pivot pin structure would also be used. Due to the pretensioning of the relatively large springs, normal operating dredging forces will not significantly move the pivot axis, thereby giving the installation the advantages of the previously known rigid structure, while providing the additional advantage of shock attenuation for the expected extreme operating conditions.

Figure 11:
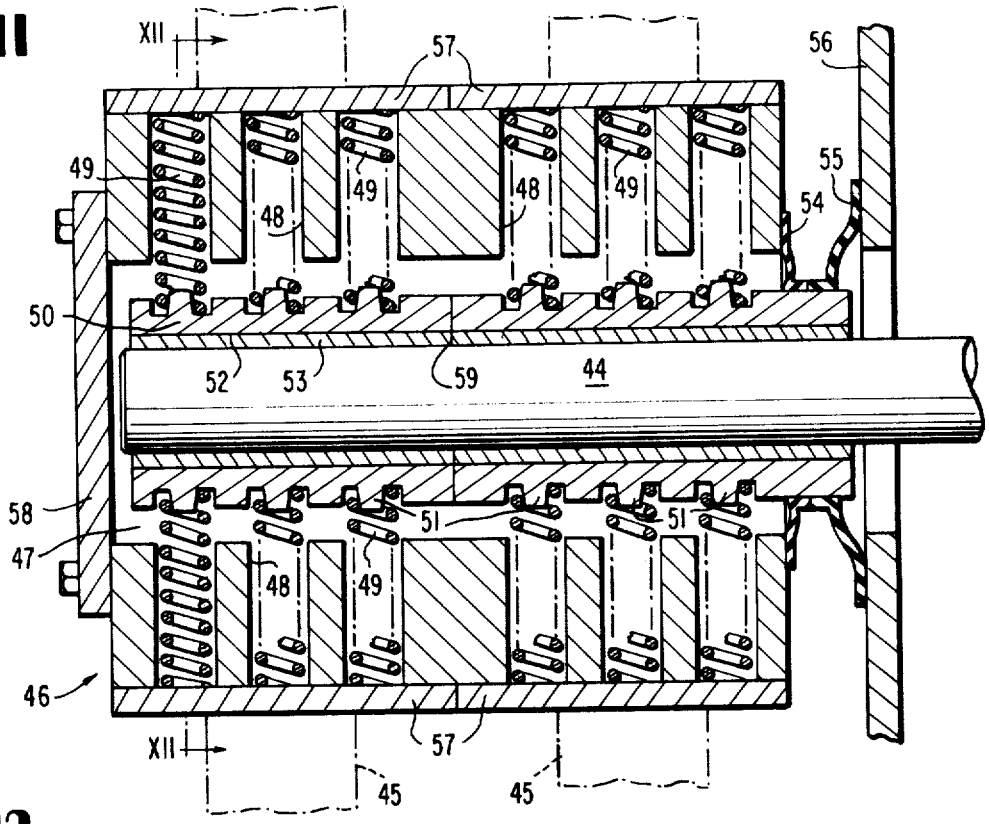
FIG. 11 is a cross-sectional view taken along the plane XI—XI of FIG. 10.
Figure 12:
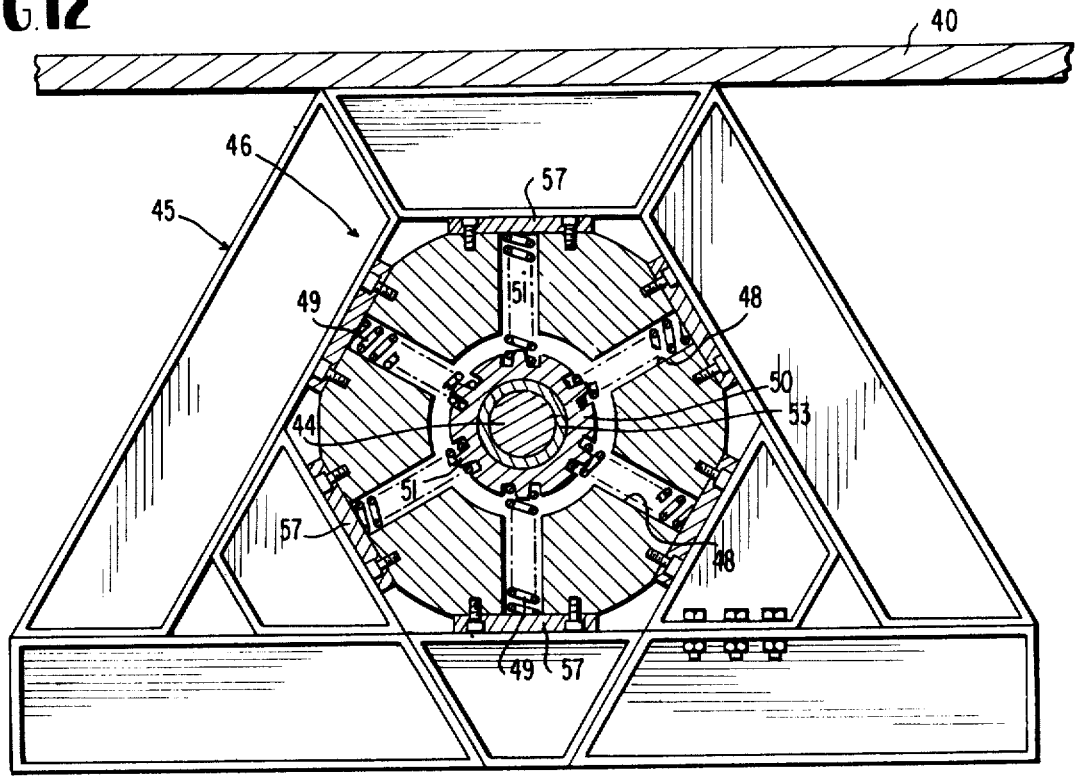
FIG. 12 is a partial cross-sectional schematic view taken along the plane XII—XII of FIG. 11.

The embodiment shown in FIGS. 10 to 12 is usable on a dredging barge or platform 40, of the type having the pivot axis *p–p'* spaced inwardly from the rear edge 41 of the barge. The rigid ladder 42 has a drilling or dredging head 43 mounted at the outer end thereof for dredging in a conventional manner. The mounting connection between the ladder 42 and the barge 40 includes a right and left pivot shaft or pin 44, 44' respectively, attached rigidly to the ladder structure. Alternatively, a single pivot shaft could be extended completely through the ladder, either rotatably fixed with respect to the ladder or through bearings in the ladder.

Mounted within the framework 45 under the deck of the barge 40, are two spaced housing structures 46 and 47. These housings structures are arranged at opposite ends of the pivot pin arrangement connected to the rigid dredge ladder 42. Since each of these housing structures 46 and 47 are substantially similar, only the lefthand housing 46 is shown at FIGS. 11 and 12 of the drawings and is discussed in the following paragraphs.

As best seen in FIGS. 11 and 12, basic housing structure 46 is supported on the barge by way of the framework 45. A cylindrical housing chamber 47 extends longitudinally in the direction of the pivot axis *p–p'*. Cylindrical guide chambers 48 extend radially outwardly from the housing chamber 47. A spring 49 or other shock absorbing member is arranged in each of the guide chambers 48 for resiliently supporting a movable support block 50 such that the support block can move against the force of the springs in all radial directions. This support block 50 includes abutment means, such as the conical abutments 51 for guiding the end of the spring in engagement with the support block 50. Support block 50 is preferably made in two sections, split at line 59, to aid in the assembly operation.

The support block 50 has a cylindrical aperture 52 extending from one end to the other with a bearing means 53 arranged therein. The lefthand end of pivot pin 44 is inserted within the bearing 53 arranged therein. The lefthand end of pivot pin 44 is inserted within the bearing 53 of the support block 50 so as to be rotatable with respect thereto. A seal 54 is provided for sealing the space between the housing structure 46 and the movable support block 50. A further seal 55 is provided for sealing the space between the inside bulkhead 56 and the movable support block 50. The seal 54 is operative to preclude entry of water and other foreign matter into the housing chamber 47 and also to hold lubricant material within said housing chamber. The seal 55 is operative to protect the pivot shaft 44 from water and other foreign matter. The springs 49 are backed up on their outer ends by head covers 57. In a preferred embodiment, three springs 49 are held in place by a single head cover 57, thereby making it possible to remove and repair springs, without dismantling the remainder of the spring support structure. In the preferred embodiment shown in the drawings, there are a series of six circumferentially spaced springs in contact with the movable support block 50. Since there are six sets of such springs axially spaced along the support block 50, 36 springs operatively support each end of the pivot pin or shaft arrangement. It is noted that there are more pins included in this particular arrangement than in the FIG. 1 embodiment because of the permissible free radial movement in the FIG. 10 embodiment. Because of this free radial movement, a greater total number of springs is necessary to account for all of the possible direction of shock forces through the pivot means. In order to make possible the removal of the bottom set of springs, the housing supporting frame structure 45 includes a removable bottom section that will permit the removal of the bottom head covers.

A removable end plate 58 is provided at the outer end of the housing structure 46 for permitting assembly and repair of the mounting. The FIG. 10 embodiment can be assembled in much the same manner as the FIG. 1 embodiment, providing a single pivot pin is used. Also, the same assembly operation could be utilized if the right and left pivot pins 44 and 44' were not rigidly connected to the ladder 42. For example, the pins could have rectangular cross-section ends for engaging in rectangular apertures in the ladders, with locking keys or pins holding them in place at the ladder. Another assembly technique that could be used if the pivot pins are rigidly connected to the ladder 42 is to hold the ladder in position and then mount the housing 46 and 47 within the framework 45 at opposite ends of the pivot structure. The movable block 50 should preferably be in two sections so that it can be assembled into the fixed housings without removing or changing the outside bulkhead of the barge.

The operation of the embodiment of FIG. 10 is substantially similar to the operation of the FIG. 1 embodiment, except for the fact that the pivot pin can move in all radial directions in the FIG. 10 embodiment while it is constrained for linear motion in the FIG. 1 embodiment.

Figure 15:
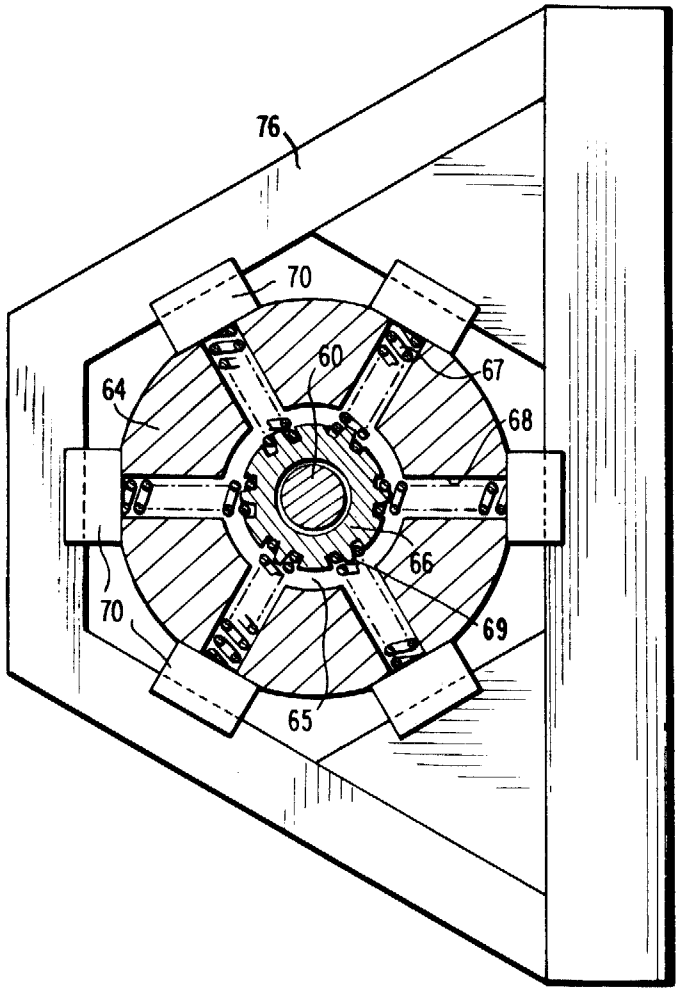
FIG. 15 is a cross-sectional view taken along the plane XV—XV of FIG. 14.
Figure 14:
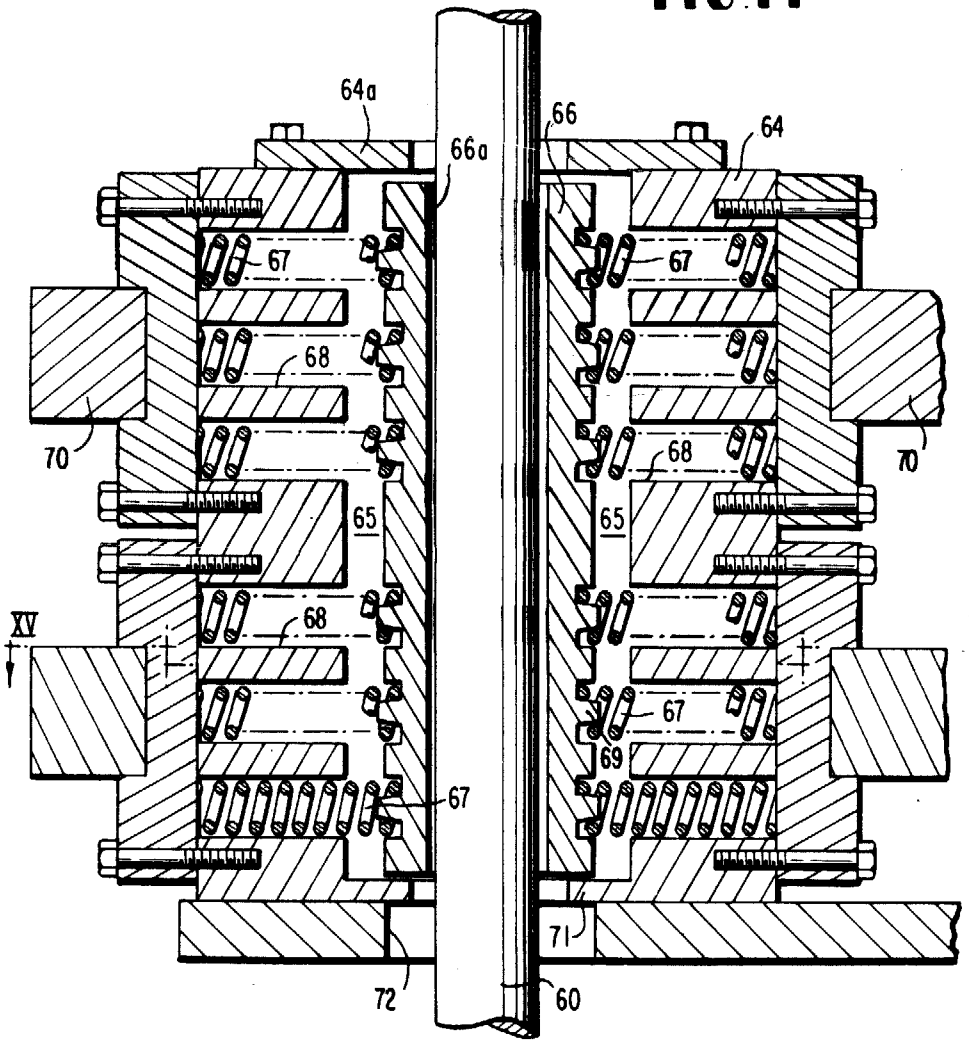
FIG. 14 is a partial cross-sectional schematic view of the shock mounting arrangement for the holding spud taken along the plane XIV—XIV of FIG. 13.

A further embodiment of the present invention is illustrated in FIGS. 13 to 15, whereby a shock mounting arrangement is provided for a holding spud 60. This holding spud 60 is mounted in a spud gate arrangement at one end of the barge 1 and extends vertically downward from the barge structure for engagement into the surface underneath the ladder adjacent the area being dredged. This holding spud 60 operates to hold the barge in a relatively fixed position during the dredging operation. A spud supporting tower structure 61 is rigidly attached to one end of the barge structure for supporting the spud in position. This holding or supporting tower 61 includes an upper supporting member 62 for holding the upper position of the holding spud in a vertical position. Means are also provided adjacent the spud support tower 61 for feeding additional lengths of spud rod and for fixing the vertical height of the spud rod on the spud support tower. Numeral 63 represents the shock mounting arrangement of the present invention, whereby the holding spud 60 is permitted a slight radial movement against spring forces, so as to attenuate any shocks that may be transferred from the spud to the barge structure during heavy winds or heavy swells in the water.

FIG. 14 illustrates the details of the shock mounting arrangement 63. This arrangement 63 includes a rigid housing structure 64 attached rigidly to the barge or spud support tower structure. This housing 64 is substantially similar to the housing structures utilized in the ladder pivot arrangement of FIGS. 10–12, except that housing 64 extends in the vertical direction. Housing 64 includes a centrally disposed cylindrical chamber 65, within which a spud holding block 66 is radially movable. This spud holding block 66 has a central aperture within which the spud 60 can slide vertically within. This aperture 66*a* in the spud holding block 66 is sufficiently larger than the outer diameter of the spud 60 so as to permit a limited radial movement prior to contact of the spud 60 with the block 66. Also, this clearance aids in the assembly of the spud within the spud holding block, and also allows for tolerances between the upper spud support 62 and the shock mounting arrangement 63. The spud holding block 66 is maintained normally in a central position with respect to the housing chamber 65 by means of springs 67, which are mounted in cylindrical guide chambers 68 provided in the housing 64. As in the other described embodiments for the pivotal connection between the dredge ladder and the barge, these springs may be guided on the spud holding block by means of conically shaped spring guide abutment means 69. Heads 70 are provided for holding the springs in place in the housing. These heads 70 are arranged for pretensioning the springs a desired amount. In a preferred arrangement, a separate head 70 is provided for each three springs. With one head 70 for each three springs 67, the springs can be exchanged during use without dismantling the connection between the spud and the remainder of the shock mounting arrangement 63, thereby avoiding unnecessary shut-downs.

The spud holding block 66 is held in place in the housing by means of the springs 67, and in addition by a bottom stop collar 71, which prevents the block 66 from sliding through the opening 72 at the bottom of the housing 64. An upper split ring 64*a* is bolted to the top of the housing 64 to hold the spud holding block from rising vertically. With this split ring arrangement, the spud holding block 66 can be lifted vertically out of the housing 64, without removing the housing from position on the barge. This split ring 64*a* may include two or more separate sections that can be detached while the spud is in position. A framework 76 is provided for attaching the housing 64 in position at the end of the barge. This spud holding embodiment of FIGS. 13–15 may include lubricating means within the housing, and seal means therefor, in the same manner as the embodiments for the pivotal ladder connection. However, such additional lubrication may not be desired, or necessary for this embodiment. (It is also noted that the other embodiments need not necessarily have the specific lubricating means in the housing to operate, however, this lubrication enhances their operation.

Although this detailed description of the various embodiments of the invention has referred to a particular end of the barge structure as being the rear end and the like, the particular end or edge of the barge whereat the ladder is mounted or the spud holder is mounted depends upon the particular usage. However, as illustrated in FIG. 13, the spud holding arrangement would, in most cases, be disposed away from the area where the dredge ladder is pivotally mounted to the barge.

While I have shown and described three basic embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are within the scope of those skilled in the art. For example, the pretensioning back-up arrangement for the springs in the FIG. 1 embodiment could likewise be utilized on the embodiments of FIGS. 10 and 13. Also, it would be possible to utilize a movable block arrangement such as shown at FIG. 10 in the FIG. 1 embodiment so as to permit free radial movement in all directions of the pivot pin. Also, hydraulic means, rubber means, or other shock absorbing arrangements could be substituted for the springs in each of the embodiments of the present invention.

I claim:

1. A shock mounting arrangement for supporting a longitudinally extending pin comprising at least one housing means surrounding a portion of the pin, said housing means including a plurality of radially extending guide chambers, and resilient means arranged in each of said guide chambers for operatively resiliently supporting the pin for limited radial movement, characterized in that the housing means includes a first and a second housing structure, said first housing structure having a first movable support block radially supported by the resilient means, said first support block having an aperture for accepting a corresponding first portion of said pin, said second housing structure having a second movable support block resiliently supported by the resilient means, said second support block having a polygon shaped aperture for accepting a corresponding second polygon shaped portion of said pin, and characterized in that said first portion of said pin has a smaller maximum radial dimension than does the second portion of said pin, whereby the first portion can be sequentially passed through the aperture of the second support block and the first support block.

2. An arrangement according to claim 1, characterized in that said first and second housing structures are positioned at opposite ends of the pin, said housing structures having axial openings for permitting insertion and removal of said movable support blocks, said second housing structure also having a removable cover plate for permitting the insertion of the pin through the housing structure.

3. A mounting arrangement for mounting one end of a rigid member on a platform; said arrangement comprising: pivot pin means for supporting the member for pivotal movement about a member pivot axis, and pivot pin support means operatively connected to the platform for supporting the pivot pin means with respect to said platform, said support means including shock absorbing means for absorbing shock forces transmitted from said member to said pivot pin means by permitting movement of said pivot pin means against the force of said shock absorbing means, wherein said shock absorbing means supports the pivot pin means in a central position such that movement of said pivot pin means from said central position is resiliently opposed by said shock absorbing means in at least two opposite radial directions of said pivot pin means, characterized in that said support means includes housing means for said pin means, said housing means being rigidly attachable to the platform, said shock absorbing means being arranged within said housing means, and characterized in that guide means are arranged in said housing means for guiding the radial movement of said pin means in a single plane perpendicular to the member pivot axis whereby the pivot axis is restricted to movement linearly in said plane, characterized in that said guide means includes at least one sliding block in the housing means, each of said sliding blocks having an aperture fitted over portions of said pivot means, each of said sliding blocks further having two oppositely disposed flat surfaces extending parallel to one another for slidably engaging two oppositely disposed substantially parallel inner housing wall surfaces on said housing means whereby each of the sliding blocks and associated pivot pin means are guided for linear movement within the housing means, characterized in that said pivot pin means includes at least one pin, and in that the housing means for each pin includes a first and second housing structure positioned respectively at opposite ends of the respective pin, each of said housing structures having sliding blocks with apertures surrounding respective end portions of the respective pins, and characterized in that the sliding block associated with the first housing structure has a cylindrical aperture for accepting a first cylindrical end section of the respective pin, and in that the sliding blocks associated with the second housing structure has a rectangular opening for accepting a rectangular cross-section end portion of the respective pin, whereby the respective pin is rotatably fixed with respect to said housing structure.

4. Apparatus according to claim 3, characterized in that said spring means includes coil springs arranged in cylindrical guide members of said housing means, said cylindrical guide chambers extending radially with respect to said member pivot axis, the inner ends of said coil springs being in engagement with respect to sliding blocks.

5. Apparatus according to claim 4, characterized in that removable and adjustable spring back-up means are provided in said housing for pretensioning the respective coil springs to preclude radial movement of said pin means until predetermined shock forces are experienced thereby, said back-up means operatively engaging the outer ends of said springs.

6. Apparatus according to claim 3, characterized in that the bearing means in said member are positioned respectively between the first and second housing structures associated with each pin.

7. Apparatus according to claim 6, characterized in that the first cylindrical end section of the pin is no larger than the cylindrical portion of the pin extending through the bearing means, that the cylindrical portion extending through the bearing means has a diameter less than the smallest side of the rectangular end portion of the pin, and that the second housing structure has a pin assembly opening oppositely disposed with respect to the bearing means for accepting the pin, whereby the pin can be assembled into the housing structure by insertion of the cylindrical end portion of the pin through the pin assembly opening of the second housing structure and then through the sliding block of the second housing structure and then through the bearing means and lastly into the first housing structure and associated sliding block.

8. A mounting arrangement for mounting one end of a rigid member on a platform; said arrangement comprising: pivot pin means for supporting the member for pivotal movement about a member pivot axis, and pivot pin support means operatively connected to the platform for supporting the pivot pin means with respect to said platform, said support means including shock absorbing means for absorbing shock forces transmitted from said member to said pivot pin means by permitting movement of said pivot pin means against the force of said shock absorbing means, wherein said shock absorbing means supports the pivot pin means in a central position such that movement of said pivot pin means from said central position is resiliently opposed by said shock absorbing means in at least two opposite radial directions of said pivot pin means, characterized in that said support means includes housing means for said pin means, said housing means being rigidly attachable to the platform, said shock absorbing means being arranged within said housing means, characterized in that guide means are arranged in said housing means for guiding the radial movement of said pin means in a single plane perpendicular to the member pivot axis whereby the pivot axis is restricted to movement linearly in said plane, characterized in that said guide means includes at least one sliding block in the housing means, each of said sliding blocks having an aperture fitted over portions of said pivot pin means, each of said sliding blocks further having two oppositely disposed flat surfaces extending parallel to one another for slidably engaging two oppositely disposed substantially parallel inner housing wall surfaces on said housing means whereby each of the sliding blocks and associated pivot pin means are guided for linear movement within the housing means, characterized in that said spring means includes coil springs arranged in cylindrical guide members of said housing means, said cylindrical guide chambers extending radially with respect to said member pivot axis, the inner ends of said coil springs being in engagement with respect to sliding blocks, characterized in that removable and adjustable spring back-up means are provided in said housing for pretensioning the respective coil springs to preclude radial movement of said pin means until predetermined shock forces are experienced thereby, said back-up means operatively engaging the outer ends of said spring, and characterized in that said back-up means includes a threaded back-up plug engaging a threaded outer portion of respective cylinder guide chambers, and in that a threaded locking plug is provided for locking the back-up plug in adjusted position, the threads of said locking plug being of the opposite hand with respect to the threads of the back-up plug.

9. Apparatus comprising a rigid platform and a rigid member pivotally mounted on said platform by means of a pivotal mounting arrangement; said pivotal mounting arrangement including pivot pin means for supporting the member for pivotal movement about a member pivot axis, and pivot pin support means operatively connected to the platform for supporting the pivot pin means with respect to said platform, said support means including shock absorbing means for absorbing shock forces transmitted from said member to said pivot pin means by permitting movement of said pivot pin means against the force of said shock absorbing means, wherein said shock absorbing means support the pivot pin means in a central position such that movement of said pivot pin means from said central position is resiliently opposed by said shock absorbing means in at least two opposite radial directions of said pivot pin means, characterized in that said support means includes rigid housing means fixedly attached to the platform, the pivot pin means including at least one pin extending through a bearing means on the member, said bearing means being spaced from the housing means, said at least one pin also extending into the housing means for operative engagement with shock absorbing means arranged within said housing means for operatively resiliently supporting the pin such that the pin can move in said at least two opposite radial directions with respect to the pivot axis against the forces of the shock absorbing means, characterized in that the pivot pin means includes two axially spaced axially aligned pins extending through two respective separate bearings in said member, and characterized in that the housing means includes four separate housing structures, each of said housing structures being fixedly connected to an outwardly spacing surface of said platform, said housing structures being positioned at opposite ends of each of the pins for supporting each of the respective pins at both ends thereof.

10. Apparatus according to claim 9, characterized in that seal means are provided for sealing said housing structures with respect to the juncture of the respective pins and the housing structures for precluding entry of water and other foreign matter into said housings.

11. Apparatus according to claim 9, characterized in that guide means are arranged in each of said housing structures for guiding the radial movement of said pins in a plane perpendicular to the member pivot axis whereby the pivot axis is moved linearly in said plane.

12. Apparatus according to claim 11, characterized in that said guide means include at least one sliding block in each of the respective housing structures for each pin, said sliding blocks having apertures fitted over portions of said pins, said sliding blocks further having two oppositely disposed flat surfaces extending parallel to one another for slidably engaging two oppositely disposed substantially parallel inner housing wall surfaces whereby the sliding blocks and associated pins are guided for linear movement within the housing means.

13. Apparatus comprising a rigid platform and a rigid member pivotally mounted on said platform by means of a pivotal mounting arrangement; said pivotal arrangement including pivot pin means for supporting the member for pivotal movement about a member pivot axis, and pivot pin support means operatively connected to the platform for supporting the pivot pin means with respect to said platform, said support means including shock absorbing means for absorbing shock forces transmitted from said member to said pivot pin means by permitting movement of said pivot pin means against the force of said shock absorbing means, wherein said shock absorbing means support the pivot pin means in a central position such that movement of said pivot pin means from said central position is resiliently opposed by said shock absorbing means in at least two opposite radial directions of said pivot pin means, characterized in that said support means includes rigid housing means fixedly attached to the platform, the pivot pin means including at least one pin extending through a bearing means on the member, said bearing means being spaced from the housing means, said at least one pin also extending into the housing means for operative engagement with shock absorbing means arranged within said housing means for operatively resiliently supporting the pin such that the pin can move in said at least two opposite radial directions with respect to the pivot axis against the forces of the shock absorbing means, and characterized in that the pivot pin means includes a single pin extending through the member and in that the housing means includes two separate housing structures, each of said housing structures being fixedly connected at opposite ends of the pin to the framework of the platform at a position forwardly from the rear edge of the platform, said platform including a centrally disposed opening extending forwardly from the rear of the platform for permitting the pivotal downward movement of the member.

14. Apparatus according to claim 13, characterized in that at least one movable support block is provided in each of said housing structures, said support block having an opening for accepting an end portion of the respective pin, said spring means including a plurality of radially extending circumferentially spaced resilient springs operatively engaging said housing structure and the support block whereby the support block is resiliently supported within the housing structure such that it can move against spring forces in any radial direction of the pin in response to shock forces experienced by the pin.

15. A mounting arrangement for supporting a longitudinally extending pin means comprising pin support means, said support means including shock absorbing means for absorbing shock forces transmitted to said pin means by permitting movement of said pin means against the force of said shock absorbing means, wherein said shock absorbing means supports the pin means in a central position such that movement of said pin means from said central position is resiliently opposed by said shock absorbing means in at least two opposite radial directions of said pin means, characterized in that said support means includes housing means for said pin means, said shock absorbing means being arranged within said housing means, and characterized in that guide means are arranged in said housing means for guiding the radial movement of said pin means in a single plane perpendicular to a pin means axis whereby the pin means axis is restricted to movement linearly in said plane, characterized in that said guide means includes at least one sliding block in the housing means, each of said sliding blocks having an aperture fittable over portions of said pin means, each of said sliding blocks further having two oppositely disposed flat surfaces extending parallel to one another for slidably engaging two oppositely disposed substantially parallel inner housing wall surfaces on said housing means whereby each of the sliding blocks and associated pin means are guidable for linear movement within the housing means, characterized in that the housing means for said pin means includes a first and second housing structure positioned respectively at opposite ends of the pin means, each of said housing structures having sliding blocks with apertures for surrounding respective end portions of the pin means, and characterized in that the sliding blocks associated with the first housing structure has a cylindrical aperture for accepting a first cylindrical end section of the pin means, and in that the sliding blocks associated with the second housing structure has a rectangular opening for accepting a rectangular cross-section end portion of the pin means, whereby the pin means is rotatably fixed with respect to said housing structure.

* * * * *